US005822437A

United States Patent [19]

Winterer

[11] Patent Number: 5,822,437

[45] Date of Patent: Oct. 13, 1998

[54] SIGNAL MODIFICATION CIRCUIT

[75] Inventor: Martin Winterer, Gundelfingen, Germany

[73] Assignee: Deutsche ITT Industries GmbH, Freiburg, Germany

[21] Appl. No.: 754,144

[22] Filed: Nov. 22, 1996

[30] Foreign Application Priority Data

Nov. 25, 1995 [EP] European Pat. Off. ..... 95118595

[51] Int. Cl.[6] ..... H04R 5/00

[52] U.S. Cl. ..... 381/1

[58] Field of Search ..... 381/1, 17, 63, 381/13, 61, 28, 2

[56] References Cited

U.S. PATENT DOCUMENTS

| | | | |
|---|---|---|---|
| 5,263,086 | 11/1993 | Yamazaki | 381/1 |
| 5,440,638 | 8/1995 | Lowe et al. | 381/17 |
| 5,661,810 | 8/1997 | Chahabadi et al. | 381/13 |

FOREIGN PATENT DOCUMENTS

| | | |
|---|---|---|
| 0538600A2 | 4/1993 | European Pat. Off. . |
| 3733809A1 | 4/1988 | Germany . |
| 91023838 | 3/1990 | Germany . |
| 91074363 | 3/1991 | Germany . |
| 4028447A1 | 3/1992 | Germany . |
| 4030424A1 | 4/1992 | Germany . |
| 4030971A1 | 4/1992 | Germany . |
| 4129638A1 | 3/1993 | Germany . |
| 4141546A1 | 6/1993 | Germany . |
| 4236047A1 | 4/1994 | Germany . |
| WO9213741 | 8/1992 | WIPO . |

OTHER PUBLICATIONS

German Search Report, Apr. 13, 1995, 195 10 288.6.

PCT International Search Report, 28 May 1996, PCT/EP96/01162.

*Primary Examiner*—Vivian Chang

*Attorney, Agent, or Firm*—Plevy & Associates

[57] ABSTRACT

A circuit is disclosed for modifying a first signal and a second signal from a signal source providing at least two signals. The circuit including devices for forming signal components from the first and second signals. The signal components are then combined into a modified first signal and a modified second signal by means of a first combining device and a second combining device, respectively.

18 Claims, 2 Drawing Sheets

SIGNAL MODIFICATION CIRCUIT

BACKGROUND OF THE INVENTION

1. Field of the Invention

The present invention relates generally to electronic circuits and more particularly to an electronic circuit for modifying a first signal and a second signal which are either present alone or are associated with further signals.

2. Description of the Prior Art

Signal modification circuits are known to increase or reduce particular effects of the information contained in the signals. One applications is, for example, a contour amplifier in the case of signals which are combined with optical signals and which are formed by raster scanning or by a plurality of sensors. For signals which are combined with sound waves there are similar applications which extend from very low frequencies to far into the ultrasonic range. Thus, seismic signals can be evaluated as well as high-frequency signals in the ultrasonic range, as employed in materials testing, for example. This includes the normal audio range.

In the simplest case, the modification circuit processes stereo signals encoded by one of the standard techniques, whereby a left signal and a right signal are transmitted in coded form as a sum signal and a difference signal. By means of the known modification circuits, the so-called stereo base can be changed electronically, so that the two associated loudspeakers seem to be located further apart. Changes of effects may also be produced in more sophisticated reproduction systems with more than two loudspeakers and/or more than two signals which provide a three dimensional sound effect that can be changed by the modification circuit.

U.S. Pat. No. 5,136,650, for example, discloses a complex sound reproduction system in which six spatially distributed loudspeakers are controlled individually to reproduce two original signals. An effect control simulates a three-dimensional effect which was not originally present.

In the journal "Elrad, 1994, No. 7, pages 76 to 81, an article entitled "Effekthascherei" describes how the stereo base can be widened by electronic means and how a three-dimensional effect can be produced by means of a surround matrix. Three basic circuits are presented, each of which is optimal for a particular signal characteristic. Since these circuits cannot follow a change in signal characteristics because in these cases the effect control may result in a degraded overall auditory sensation.

It is therefore, an object of the present invention, to provide an electronic circuit for modifying at least two signals which can be adapted to the respective signal characteristics in a simple manner.

SUMMARY OF THE INVENTION

This above object is attained by providing a circuit for modifying a first signal and a second signal from a signal source providing at least two signals. The circuit including a first terminal for receiving the first signal and a second terminal for receiving the second signal. A Means for generating a plurality of signal components from the first and second signals. A first combining device coupled to the component generating means for combining a first portion of the plurality of signal components in order to provide a first modified output signal. A second combining device also coupled to the component generating means for combining a second portion of the plurality of signal components in order to provide a second modified output signal.

BRIEF DESCRIPTION OF THE DRAWING

The above objects, further features and advantages of the present invention are described in detail below in conjunction with the drawings, of which.

DETAILED DESCRIPTION OF THE DRAWING

The present invention is directed to a circuit for modifying a first signal and a second signal from a signal source providing at least two signals. The circuit including devices for forming signal components from the first and second signals. The signal components are then combined into a modified first signal and a modified second signal by means of a first combining device and a second combining device, respectively.

The first combining device is utilized to produce the first modified output signal by combining first and second signal components which are related to the first signal with a third signal component related to the second signal. The second combining device is utilized to produce the second modified output signal by combining fourth and fifth signal components which are related to the second signal with a sixth signal component related to the first signal.

Figure 1:
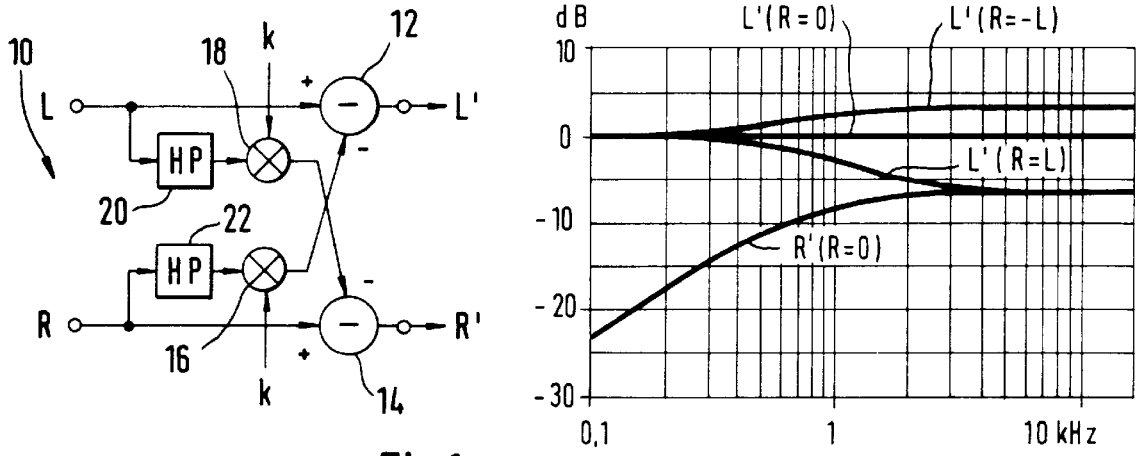
Fig.1 (Prior Art)
FIG. 1 shows a prior art modification circuit.
Figure 2:
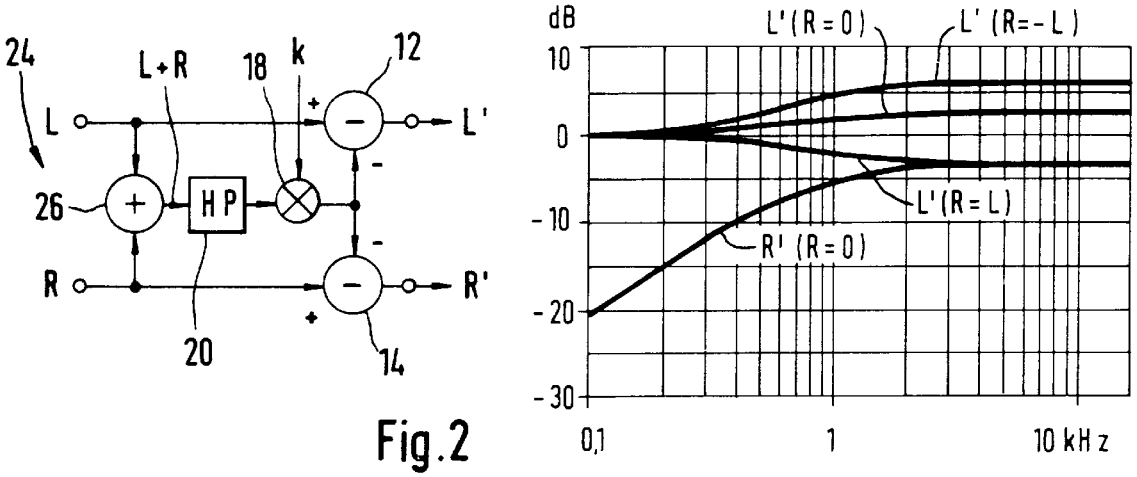
Fig.2 (Prior Art)
FIG. 2 shows another prior art modification circuit.
Figure 3:
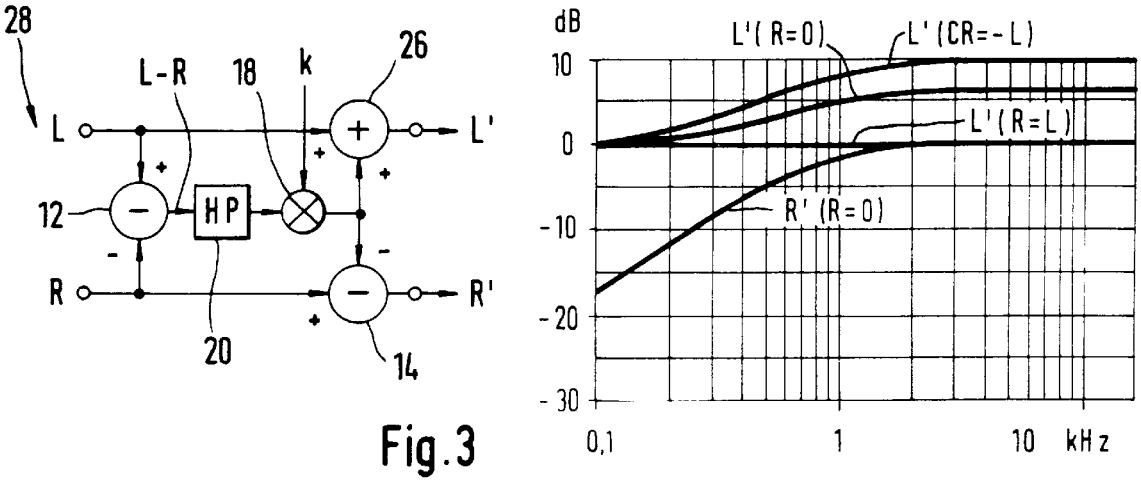
Fig.3 (Prior Art)
FIG. 3 shows another prior art modification circuit.

The known modification circuits of FIGS. 1–3 are contained, for example, in the above-cited article published in "Elrad", 1994, No. 7, pages 76 to 81. Each of the circuits has an input for a left signal L and another input for a right signal R. Accordingly, each of the circuits has an output for a modified left signal L' and another output for a modified right signal R'. Each circuit includes a first combining device and a second combining device, in which different signal components are combined, generally added or subtracted, to obtain the modified output signals L' and R', respectively.

Each of these modified signals is then fed to at least one loudspeaker (not shown). These loudspeakers must not be located too close together. It is known that a directional effect is produced only if the two signals L & R and, hence the signals L' and R' differ. The greater the difference, the greater the discrimination will be, so that the sound sources subjectively localized by the listener eventually seem to move apart. To extend the stereo base, the individual modification circuits increase the differences in the individual signals while reducing the common signal component. The common signal component is generally referred to as the mono signal, and the difference as the difference signal. These two components, as is well known, play an essential part in the transmission of the stereo multiplex signal. The mono-component by itself sounds good. The difference component, however, is not related to an actual audio signal and sounds very unpleasant.

All of the circuits of FIGS. 1–5 include filter circuits. For audio signals it is assumed, however, that the low frequency components up to a few 100 Hz are present as mono-signals, so that the directional dependence relates only to the frequency components above these low frequency components. This takes into account that the low frequencies cannot be resolved by the human ear according to direction. Thus, the individual signal components which influence the right and left signals are high-pass filtered signals, so that the filter circuits, which act in the forward direction with respect to the position of the listener, are implemented with high-pass filters.

The respective contributions of the individual signal components to the modification are controlled by multipliers and weighting factors, which can be either negative or positive, but greater than 1 in magnitude. In reality, the weighting factors vary within relatively narrow ranges, because otherwise the effects produced would result in an unreal sound sensation. FIGS. 2 & 3 each include only one multiplier 18 in which weighting is effected by an applied signal k. While FIG. 1 includes two multipliers 16,18 which are both controlled by the weighting factor k.

The considerations underlying the individual circuits of FIGS. 1–3 are described in the following. How these modifications affect the individual modified signals is illustrated in the respective opposite frequency diagrams by the following characteristic signal contents:

In one characteristic, the original first and second signals L and R are oppositely equal: R=−L. This means that the sum signal which is equal to the mono signal (R+L) has a value of zero, while the difference signal (L−R) has its maximum value.

In another characteristic, the original first and second signals L and R are equal: R=L. This means that the sum signal which is equal to the mono signal (R+L)) has its maximum value, while the difference signal (L−R) has a value of zero.

In a further characteristic, one of the original signals L and R has a value of zero: e.g., R=0. This means that the sum signal (L+R) and the difference signal (L−R) are equal in magnitude. Therefore, the sum signal (R+L) may simulate an unspecific signal (mono signal) in the modification, which affects the result of the modification in an inappropriate circuit. By these extremely single-sided signals L and R, with R=0, it can be illustrated to what extent signal components are coupled into the wrong signal branch in the respective modification circuit.

In any case, the aim is that after the modification, the frequency response remains as flat as possible because otherwise an unreal sound impression would result. The overall perception of loudness should not be changed, either.

Referring to FIG. 1, a first known modification circuit is shown. In this circuit 10, the directional effect is increased by subtracting a portion of the first signal L and a portion of the second signal R. The portions of the signals L,R utilized is determined by the weighting factor k and by the other signals respective high-pass filters 20,22. From the opposite frequency diagram, it is apparent that this modification is ideal if either only a first signal L or only a second signal R is present. In that case, the associated frequency response L', with R=0, is flat. At higher frequencies, signals having a larger sum component L+R (i.e., R is approximately equal to L) will appear attenuated, while oppositely equal signals R=−L will be enhanced. Thus, at high frequencies, signals with a larger mono component will sound dull and signals with a larger difference component will be emphasized in an unpleasant manner.

Referring to FIG. 2, another known modification circuit is shown. This circuit 24, increases the directional effect by subtracting from the first signal L and the second signal R signal components with equal signal contents, i.e., signals with a large sum component L+R, whereby differences in the first and second signals are emphasized. From the opposite frequency diagram, it is apparent that this is optimal for a composite signal which has a substantial sum component R+L and, in addition, an enhanced or greatly attenuated signal component, e.g., R=0. In the case of audio signals, this corresponds to a single-sided signal source and a large mono component.

Referring to FIG. 3, there is shown another known modification circuit. In this circuit 28, a subtracter 12 forms a difference signal L−R from the first signal L and second signal R. The difference signal L−R is fed through a high-pass filter 20 and a weighting stage 18 to form a signal component which is added to the first signal L and subtracted from the second signal R. Through the addition and subtraction of the difference value, the difference of the first and second signals is increased, so that the modified signals L' & R' at the output show an increased directional effect and thereby extend the stereo base.

The opposite frequency diagram shows that the circuit 28 of FIG. 3 has an ideal frequency response for unspecific signals, e.g., mono signals with R=L. For differing signals, i.e., in a borderline case for oppositely equal signals R=−L, the frequency response is very unfavorable. At higher frequencies these signals are boosted up to 10 dB, and therefore degrade the sound impression.

The present invention teaches that a general circuit with which all variants can be implemented can be realized by incorporating further signals components in the respective modification whose action is controlled by associated weighting factors. The individual signal components are also combined, i.e., added or subtracted, by means of combining devices to finally obtain a modified first signal L' and a modified second signal R'.

Figure 4:
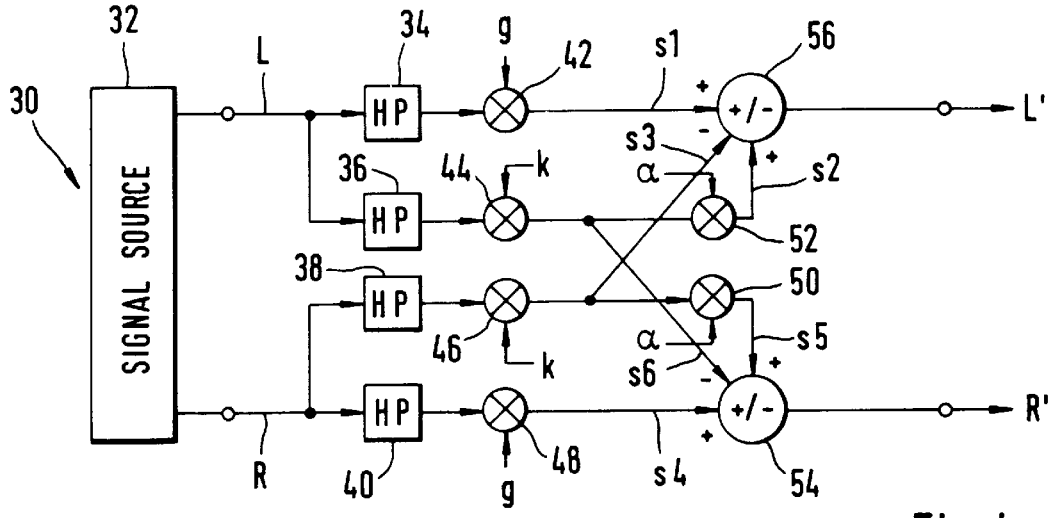
FIG. 4 shows a first embodiment of the modification circuit according to the present invention.

Referring to FIG. 4, a first embodiment of the modification circuit according to the present invention is shown. In this circuit 30, each modified signal is formed by three signal components. To perform arbitrary modifications, each signal component should be modified individually by means of a filter circuit and a weighting factor. In this respect, the embodiment of FIG. 4 already represents a simplification, because pairs of signal components s2, s6 and s5, s3 are passed through single filter circuits 36,38, respectively.

A signal source 32 provides at its output a first signal L and a second signal R. The signal source 32 is not definitely determined; it may also be, for example, a multiple signal source with parallel outputs, in which case the first and second signals correspond to adjacent signals. For the sake of clarity, the embodiments are limited to stereo signals, with the first signal L corresponding to a left signal and the second signal R to a right signal. In these cases, the signal source 32 includes a decoder for stereo multiplex signals.

In the circuit 30 of FIG. 4, the first signal L passes through a filter 34 and a weighting device which is a multiplier 42, and is applied as a first signal component s1 to an input of a combining device 56. The associated weighting factor g is applied to the multiplier 42 as a data value or corresponds to a fixed arithmetic shift. The weighting factor g has a value normally in the range of approximately "1". This weighting factor controls both of the main signal paths and may be altered optionally in very few cases.

The first signal L is also applied to the input of another filter 36, which is followed by another weighting device 44 to form a sixth signal component s6. The sixth signal component s6 is fed to another combining device 54, which has an output that provides the second modified signal R'. The combining devices 54,56 are adder/subtracter circuits having two adding inputs and one subtracting input.

The weighting device 44 is a multiplier having a weighting input fed with another weighting factor k. The weighting factor k is an important factor for the desired "stereo base changing effect". For k=0, no additional effects are produced and stands for an "off" state which is a condition that should be allowed by the system. For k=1, the sound impression is unnatural and thus is a condition that should not be allowed by the system. Typical values for the weighting factor k are in the range of 0.5 to 0.6. After the the weighting device 44, the signal passes through a weighting device 52 and is applied as a second signal component s2 to the combining device 56. The weighting in this weighting device 52 is effected by a multiplier having a weighting input supplied with an additional weighting factor α.

Parallel to the first, second, and sixth signal components s1, s2, and s6 which are formed from the first signal L, a third, fourth and fifth signal components s3, s4 and s5 are formed from the second signal R. Filters 38,40 and correspond to the previously described filters 34,36, respectively. Three additional multipliers 46,48,50 correspond to the previously described multipliers 42,44,52 respectively. These multipliers 48,46,50 are fed with the weighting factors g, k, and α, respectively.

The third and sixth signal components s3 and s6 are applied to the subtracting inputs of the combining devices 56,54, respectively. The need for the subtracting input can be avoided if the associated weighting factors are changed in sign.

Figure 5:
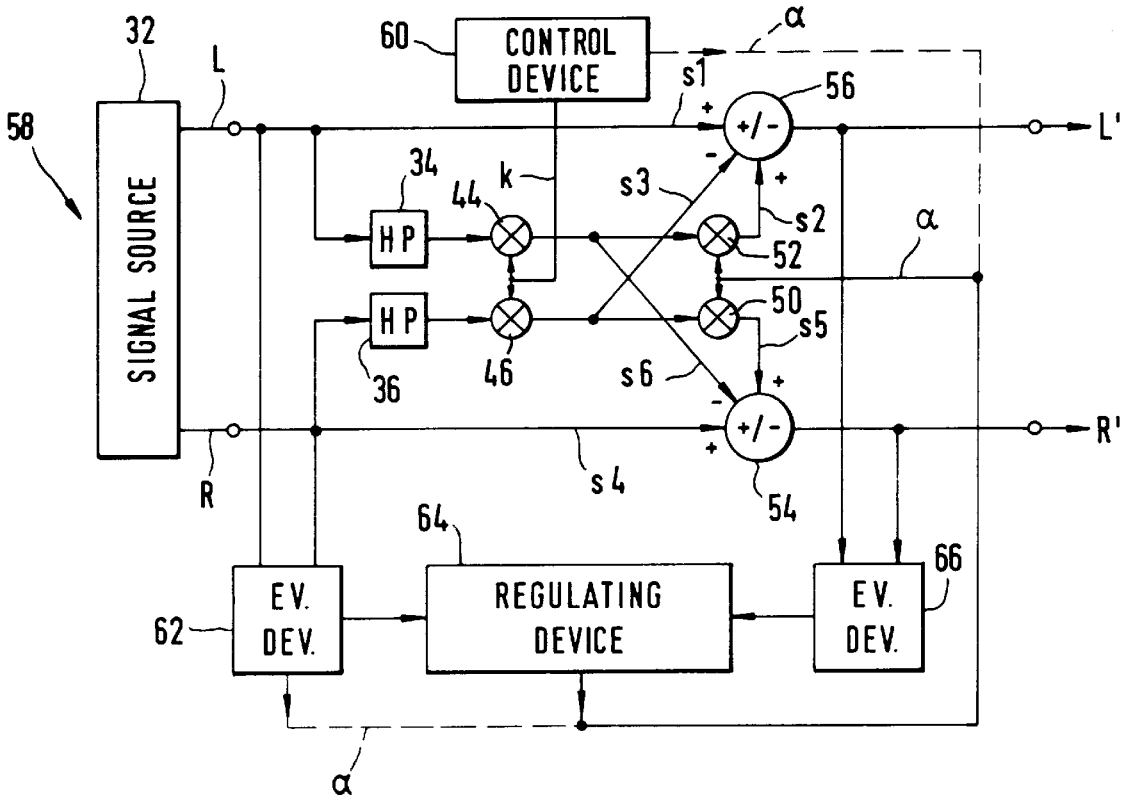
FIG. 5 shows another embodiment of the modification circuit according to the present invention.

Referring to FIG. 5, there is shown another embodiment of the modification circuit according to the present invention. This embodiment 58 is a simplified form of the circuit shown in FIG. 4. The circuit 58 further includes a regulating device 64 and a control device 60 for adjusting and/or presetting the weighting factors. This embodiment of the circuit 58 is even more specifically adapted to process audio signals than the more general circuit of FIG. 4. The signal source 32 provides a first signal L which is the left signal and a second signal R which is the right signal.

The first and fourth signal components s1 and s4 are neither filtered nor weighted but correspond directly to the first and second signals L and R, respectively. By means of a high-pass filter 34 and a weighting device 44 which is a multiplier effected by the weighting factor k, the first signal L is changed into the sixth signal component s6, which is applied to the subtracting input of the combining device 54. In a similar manner, a high-pass filter 36 and another weighting device 46 which is also a multiplier affected by the same weighting factor k changes the second signal R into the third signal component s3, which is applied to the subtracting input of the combining device 56.

The weighting factor k is provided by the control device 60, which thus determines the magnitude of the desired effect, and hence the stereo base width. The control device 60 is preferably embodied by a processor with a memory containing the weighting factor k. However, the control device 60 also can be embodied by a manually operated unit or another type of control unit. In the present invention, the weighting factor k is independant of the input signals and is is normally to be controlled by an outside position.

Since, as stated above, direction dependence in the case of conventional stereo signals exists only in the medium and upper frequency ranges, the second, third, fifth, and sixth signal components s2, s3, s5 & s6 are formed by means of high-pass filters 34,36 having a cutoff frequency higher than 300 Hz, typically 700 Hz.

From the frequency diagrams of FIGS. 1–3, it is apparent that via the cutoff frequency, the range of the increases or decreases in signal amplitude is changed, which affects the auditory sensation in the case of composite signals. The second and fifth signal components s2 & s5 are formed from the high-pass filtered first and second signals, respectively, by changing the magnitudes of the respective signals by means of the weighting factor α. Via the value of the weighting factor α, not only the properties of the known circuits of FIGS. 1–3, but also arbitrary intermediate stages can be adjusted, which permits optimum signal adaptation.

With a weighting factor of α=0, the frequency response of FIG. 1 is obtained, which provides optimum modification for stereo signals in which one of the two components L, R has a value of 0. With the weighting factor α lying between approximately 0.4 and 0.5, the frequency response is adjustable to correspond to the frequency response of FIG. 2 and is optimal for composite signals. The weighting factor α may also be negative to reduce the enhancement of unspecific signals in the upper frequency range. With a weighting factor of α=1, the frequency response of FIG. 3 is obtained, which is ideal for pure mono-signals or for signals with a large mono-signal component.

The weighting factor α may be adjusted in different ways: either as a fixed value via the control device 60 which is indicated in FIG. 5 by a dashed connection or adaptively, i.e., under control of the signal characteristics themselves, which are determined from the left and right signals L, R by means of an evaluating device 62, for example.

In the simplest case, the mono-signal components and difference-signal components are determined via adders and subtracters, respectively. By means of individual filters with which the physiological auditory sensitivity is approximately simulated, individual frequency ranges can be treated separately or weighted specifically. This corresponds to an adaptive control of the weighting factor α, which is shown schematically in FIG. 5 by the dashed line at the output of the first evaluating device 62.

If a corresponding evaluation is also performed on the modified output signals L' and R' by means of another evaluating device 66, the outputs of the evaluating devices 62,66 are be connected to a regulating device 64 having an output for controlling the magnitude of the weighting factors. By making a comparison between the input and output signals of the modification circuit 58, it can be ensured by means of the regulating device 64 that the perception of loudness does not change during the modification, regardless of the respective effect control. The evaluating devices 62,66 are preferably implemented by adders and/or subtractors.

The regulating device 64 is utlized to enable automatical control of the weighting factor α. The regulating device 64 is implemented by a portion of a standard control unit which normally includes an input or reference signal , a measuring or feedback signal, a comparator stage and a control stage.

If the regulating device 64 is to take into account the perception of loudness in the entire frequency range or in individual frequency ranges, the evaluating devices 62,66 must determine, inter alia, power-related data from the signals at the input and output of the modification circuit 58. In the embodiment of FIG. 5, the output of the regulating device 64 controls the weighting factor α.

It is also possible, of course, to combine the evaluating and regulating devices of FIG. 5 with the modification circuit of FIG. 4. In FIG. 4, the sharing of the first and second signals L, R can be controlled via the weighting factor g. The filters 34, 40 may be connected to or implemented by an all pass filter. The time compensations required in digital circuits are not shown in the individual circuit examples. It is again pointed out that the invention and its embodiments are by no means limited to the processing of stereo signals, but that the adaptive effect control is advantageous for many other signals.

While the invention has been particularly shown and described with reference to preferred embodiments thereof, it will be understood by those skilled in the art that changes in form and details may be made therein without departing from the spirit and scope of the present invention.

What is claimed is:

1. A circuit for modifying a first signal and a second signal comprising:

a first terminal for receiving the first signal and a second terminal for receiving the second signal;

means for generating a plurality of signal components from the first and second signals;

a first combining device having a first input coupled to said first terminal, second and third inputs, and for combining a first portion of said plurality of signal components in order to provide a first modified output signal;

a first filter, a first weighting device and a second weighting device coupled in series between said first terminal and said second input of said first combining device;

a second combining device having a first input coupled to said second terminal, second and third inputs, and for combining a second portion of said plurality of signal components in order to provide a second modified output signal;

a second filter, a third weighting device and a fourth weighting device coupled in series between said second terminal and said second input of said second combining device; and an output of said first weighting device coupled to said third input of said second combining device, and an output of said third weighting device coupled to said third input of said first combining device.

2. The circuit of claim 1, wherein said combining devices are adder/subtracter circuits.

3. The circuit of claim 1, wherein said first weighting device is a first multiplier and said third weighting device is a third multiplier, wherein said first and third multipliers are controlled by a first weighting factor (k).

4. The circuit of claim 3, which further includes a control device coupled to said first and third multipliers for providing said first weighting factor (k).

5. The circuit of claim 1, wherein said second weighting device is a second multiplier and said fourth weighting device is a fourth multiplier, wherein said second and fourth multipliers are controlled by a second weighting factor ($\alpha$).

6. The circuit of claim 5, wherein said second weighting factor ($\alpha$) is constant and said circuit further includes a control device coupled to said second and fourth multipliers for providing said second weighting factor ($\alpha$).

7. The circuit of claim 5, wherein said second weighting factor ($\alpha$) is varaiable and controlled by an evaluation device coupled across said first and second terminal.

8. The circuit of claim 7, which further includes a second evaluation device coupled across an output of each of said combining devices, an output of each said evaluation device is coupled to a regulating device, said regulating device controls said second weighting factor ($\alpha$) based on a comparison of signals received from said evaluation devices.

9. The circuit of claim 1, wherein said first and second filters are high pass filters.

10. The circuit of claim 1, which further includes a third filter and a fifth weighting device coupled between said first terminal and said first input of said first combining device; and a fourth filter and a sixth weighting device coupled between said second terminal and said first input of said second combining device.

11. The circuit of claim 10, wherein said third and fourth filters are high pass filters.

12. The circuit of claim 10, wherein said fifth weighting device is a fifth multiplier and said sixth weighting device is a sixth multiplier, wherein said fifth and six multipliers are controlled by a third weighting factor (g).

13. A method for modifying a first signal and a second signal, said method comprising the steps of:

generating a plurality of signal components from the first and second signals;

combining a first portion of said plurality of signal components in order to produce a first modified output signal utilizing a first combining device having a first input coupled to said first terminal, second and third inputs, and for combining a first portion of said plurality of signal components in order to provide a first modified output signal; a first filter, a first weighting device and a second weighting device coupled in series between said first terminal and said second input of said first combining device; and combining a second portion of said plurality of signal components in order to produce a second modified output signal utilizing a second combining device having a first input coupled to said second terminal, second and third inputs, and for combining a second portion of said plurality of signal components in order to provide a second modified output signal; a second filter, a third weighting device and a fourth weighting device coupled in series between said second terminal and said second input of said second combining device; and an output of said first weighting device coupled to said third input of said second combining device, and an output of said third weighting device coupled to said third input of said first combining device.

14. The method of claim 13, wherein said plurality signal components includes a first signal component, a second signal component, a third signal component, a fourth signal component, a fifth signal component and a sixth signal component.

15. The method of claim 14, wherein said first, second and third signal components are combined to form said first modified output signal and, said fourth, fifth and sixth signal components are combined to form said second modified output signal.

16. The method of claim 14, wherein said second and fifth signal components are formed by first high pass filtering said first and second signals and then multiplying said filtered first and second signals by both a first weighting factor (k) a second weighting factor ($\alpha$).

17. The method of claim 14, wherein said third and sixth signal components are formed by first high pass filtering said first and second signals and then multiplying said filtered first and second signals by a weighting factor (k).

18. The method of claim 14, wherein said first and fourth signal components are formed by first high pass filtering said first and second signal components and then multiplying said filtered first and second signals by a third weighting factor (g).

* * * * *